US008537053B2

(12) United States Patent
Viala et al.

(10) Patent No.: US 8,537,053 B2
(45) Date of Patent: Sep. 17, 2013

(54) LEFT HANDED BODY, WAVE GUIDE DEVICE AND ANTENNA USING THIS BODY, MANUFACTURING METHOD FOR THIS BODY

(75) Inventors: Bernard Viala, Sassenage (FR); Evangeline Benevent, Grenoble (FR); Kevin Garello, Locmaria-Plouzane (FR)

(73) Assignees: Commissariat a l'Energie Atomique et aux Energies Alternatives, Paris (FR); Centre National de la Recherche, Paris (FR)

( * ) Notice: Subject to any disclaimer, the term of this patent is extended or adjusted under 35 U.S.C. 154(b) by 413 days.

(21) Appl. No.: 12/838,617

(22) Filed: Jul. 19, 2010

(65) Prior Publication Data

US 2011/0012791 A1 Jan. 20, 2011

(30) Foreign Application Priority Data

Jul. 20, 2009 (FR) ..... 09 03549

(51) Int. Cl.
*H01Q 1/38* (2006.01)

(52) U.S. Cl.
USPC ..... 343/700 MS; 333/202; 333/240

(58) Field of Classification Search
USPC ..... 343/700 MS
See application file for complete search history.

(56) References Cited

U.S. PATENT DOCUMENTS

| | | | | |
|---|---|---|---|---|
| 7,978,394 | B1 * | 7/2011 | Johnson et al. | 359/282 |
| 2001/0038325 | A1 * | 11/2001 | Smith et al. | 333/202 |

FOREIGN PATENT DOCUMENTS

| | | | |
|---|---|---|---|
| FR | 2852400 | | 9/2004 |
| WO | 01/71774 | A2 | 9/2001 |
| WO | 03/075291 | A1 | 9/2003 |

OTHER PUBLICATIONS

Garcia-Miquel et al. "Experimental Evidence of Left Handed Transmission Through Arrays of Ferromagnetic Microwaves" Applied Physics Letters, 94: pp. 054103-1 to 054103-3 (Feb. 6, 2009).
Chen et al. "Left-handed Materials Made of Dilute Ferromagnetic Wire Arrays with Gyrotropic Tensors" Journal of Applied Physics, 102: pp. 023106-1 to 023106-7 (Jul. 24, 2007).
Lamy et al. "Combination of Ultimate Magnetization and Ultrahigh Uniaxial Anisotropy in CoFe Exchange-Coupled Multilayers" Journal of Applied Physics, 97: pp. 10F910-1 to 10F910-3 (May 10, 2005).
Veselago "The Electrodynamics of Substances with Simultaneously Negative Values of ϵ and μ" Soviet Physics Uspekhi, 10(4): pp. 509-514 (Jan. 1968).

(Continued)

*Primary Examiner* — Douglas W Owens
*Assistant Examiner* — Jae Kim
(74) *Attorney, Agent, or Firm* — Occhiuti Rohlicek & Tsao LLP

(57) ABSTRACT

This left-handed substance comprises an array of conductive wires positioned relative to one another in such a way as to present a negative permittivity relative to the electromagnetic waves which have an electrical field parallel to the biggest dimension of these wires and are propagated at a frequency below the electrical plasma frequency of the substance, each wire being made out of a conductive magnetic material having negative permeability for a range of frequencies of the electromagnetic waves below the electrical plasma frequency of the substance and when there is no external artificial static magnetic field. Each wire comprises at least one strip, made out of a conductive magnetic material that extends along the greatest dimension of the wire in a plane of the strip and has a thickness at least twice as small as the skin thickness of the conductive magnetic material.

15 Claims, 2 Drawing Sheets

(56) References Cited

OTHER PUBLICATIONS

Pendry et al. "Magnetism from Conductors and Enhanced Nonlinear Phenomena" IEEE Transactions on Microwave Theory and Techniques, 47(11): pp. 2075-2084 (Nov. 11, 1999).
Pendry et al. "Extremely Low Frequency Plasmons in Metallic Mesostructures" Physical Review Letters, 76(25): pp. 4773-4776 (Jun. 17, 1996).
Zhao et al. "Magnetotunable Left-handed Material Consisting of Yttrium Iron Garnet Slab and Metallic Wires" Applied Physics Letters, 91: pp. 131107-1 to 131107-3 (Sep. 26, 2007).
Shelby et al. "Experimental Verification of a Negative Index of Refraction" Science, 292(77): pp. 77-79 (Apr. 2, 2009).
Smith et al. "Composite Medium with Simultaneously Negative Permeability and Permittivity" Physical Review Letters, 84(18): pp. 4184-4187 (May 1, 2000).

* cited by examiner

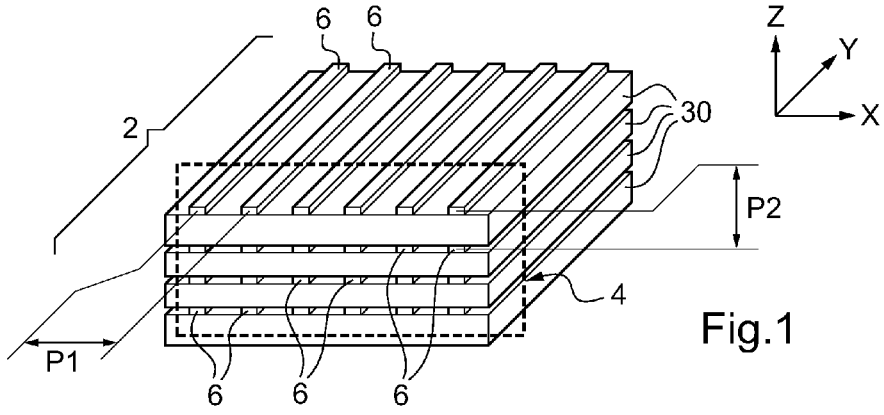
Fig.1
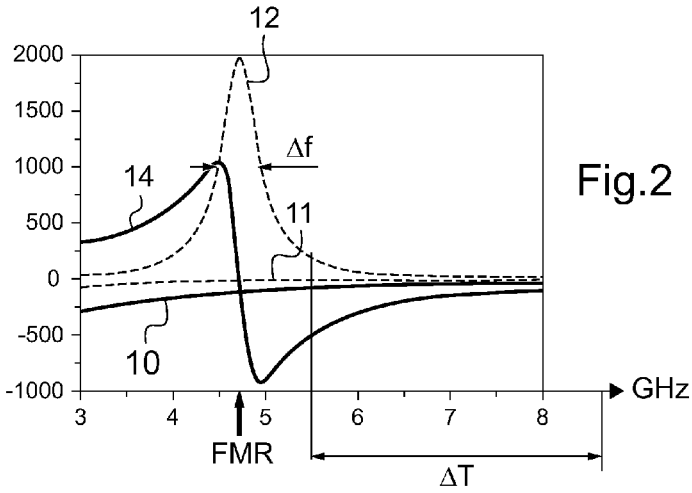
Fig.2
Fig.4
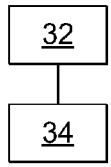
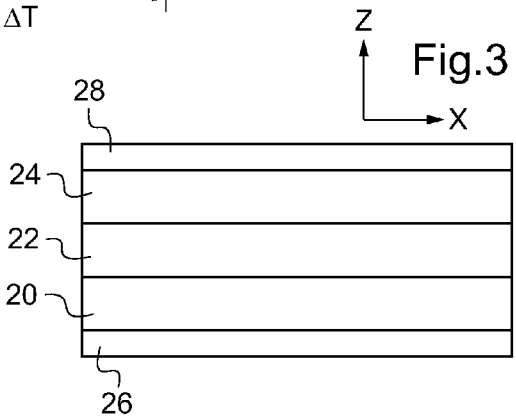
Fig.3
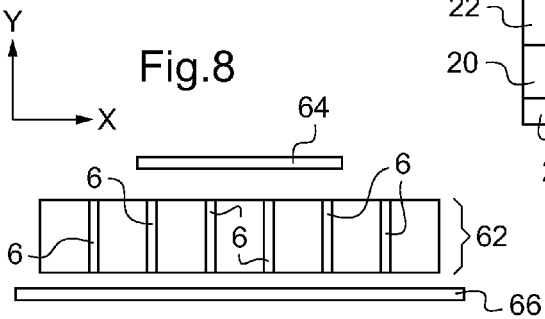
Fig.8

LEFT HANDED BODY, WAVE GUIDE DEVICE AND ANTENNA USING THIS BODY, MANUFACTURING METHOD FOR THIS BODY

CROSS-REFERENCE TO RELATED APPLICATIONS

This application claims the benefit of the priority date of French Application No. 0903549, filed on Jul. 20, 2009, the contents of which are hereby incorporated by reference in its entirety.

BACKGROUND OF THE INVENTION

1. Field of the Invention

The invention pertains to a left-handed substance as well as to a wave-guide device and an antenna incorporating this left-handed substance. An object of the invention is also a method for manufacturing this left-handed substance.

Here below in the description, unless otherwise stated, the terms "permittivity ∈" and "permeability μ" when used without any other specific information refer to relative permittivity and relative permeability.

Left-handed substances were presented for the first time by Victor Veselago in:

"The Electrodynamics of Substances with Simultaneously Negative Values of ∈ and μ", Soviet Physics USPEKHI, vol. 10, n° 4, January-February 1968".

These materials have the property of simultaneously presenting negative permittivity ∈ and negative permeability μ within a given range of frequencies. These left-handed substances have many atypical properties, such as:

- a negative refraction index,
- the trihedron formed by the vectors E (electrical field), H (magnetic field) and k (direction of propagation of the waves) is inverted (the term used is "reversed") as compared with materials with positive (the term used in this case is "forward") permittivity and permeability,
- the phase speed and the group speed have opposite signs,
- the Doppler effect is inverted,
- etc.

2. Description of the Prior Art

Because of these atypical properties, these left-handed substances may find numerous applications, especially in the processing of the electromagnetic waves.

It has been proposed especially to use these left-handed substances in wave guides, filters, or antennas. For such applications, it is desirable that the frequency band in which ∈ and μ are simultaneously negative should in the hyper-frequency domain, i.e. between 1 and 60 GHz.

Various research projects have been conducted to achieve this result. For example, a substance having these properties is described in the following document D1:

D. R. Smith, W. J. Padilla, D. C. Vier, S. C. Nemat-Nasser, and S. Schultz, "Composite Medium with Simultaneously Negative Permeability and Permittivity", Phys. Rev. Lett., Vol 84, N° 18, p. 4184, 2000.

These known substances are often called "metamaterials". They comprise a heterogeneous material formed by an array of conductive wires positioned relative to one another in such a way as to present a negative ∈ relative to the electromagnetic waves which have an electrical field parallel to the biggest dimension of these wires and are propagated at a frequency below the electrical plasma frequency of the substance.

The electrical plasma frequency as well as the sizing of this array of conductive wires to obtain a value of ∈ below zero has been described especially in the following document D2:

J. B. Pendry, A. J. Holden, W. J. Stewart, and I. Youngs, "Extremely Low Frequency Plasmons in Metallic Mesostructures", Phys. Rev. Lett., Vol. 76, N° 25, 1996.

Broadly speaking, the electrical plasma frequency of the substance is the value of the frequency of the incident electromagnetic wave for which the real part of ∈ gets cancelled out.

These prior-art substances generally comprise another heterogeneous material formed by another array of conductive patterns that are laid out relatively to one another so as to present a negative value of μ in the desired frequency band. Typically, this other array is a array of conductive split rings (also known as Pendry rings) used to artificially generate a negative μ value through an electromagnetic resonance phenomenon LC in a range of frequencies situated immediately after the magnetic plasma resonance frequency. Broadly speaking, the magnetic plasma resonance frequency is the value of the frequency of the incident electromagnetic wave for which the real part of μ gets cancelled out. Such arrays can be used to obtain a negative μ value after the magnetic plasma resonance frequency. These arrays are for example examined in the following document D3:

J. B. Pendry, A. J. Holden, D. J. Robbins, and W. J. Stewart, "Magnetism from conductors and enhanced nonlinear phenomena", IEEE Trans. MTT, Vol. 47, N° 11, 1999.

The above two arrays are laid out so as to present both a negative ∈ value and a negative μ value.

The arrays described here above consist of an elementary pattern called an "elementary cell" repeated at regular intervals in one or more repetition directions. The regular interval is called the "pitch" of the array.

The size of the elementary cell in the direction of repetition is chosen in such a way that the substance behaves like a homogeneous material with respect to the wave illuminating this substance with a frequency included in the range of frequencies for which the values of ∈ and μ are simultaneously negative. To this end, the size of an elementary cell is chosen to be smaller than and preferably several times smaller than the wavelength of the illuminating wave and typically ten times smaller. At the same time, the pitch of the array is far greater than 1 micrometer so that, at a microscopic scale, the layout of the wires relative to one another can be clearly discerned.

These prior-art substances have several drawbacks:

- the frequency band in which ∈ and μ are simultaneously negative is narrow (i.e. it is at most a few hundred Megahertz)
- the amplitude of the absolute value of μ in this frequency band is low (i.e. it is smaller than a few units)

Furthermore, the sizing and tunability of the array that make it possible to obtain a negative μ are limited. Indeed, to obtain a negative μ for a given working frequency, it is necessary to build an array having a magnetic plasma resonance frequency neighboring this working frequency. To this end, the dimensions of the split rings must be matched with the wavelength of the working frequency. Now the modification of the size of the split rings cannot be done dynamically, thus preventing the tuning of these metamaterials at a given working frequency after it has been manufactured. Even if the working frequency is known before the manufacturing of the array, the dimensions of the split ring needed to work at this frequency may be impossible to achieve either because they are too small or because on the contrary they are far too great.

It is therefore not easy to use the known substances combining two heterogeneous materials to obtain negative values of ∈ and μ simultaneously, in physical applications.

Recently, it has been proposed to use only one array of conductive wires arranged in relation to one another so as to present negative permittivity to electromagnetic waves having an electrical field parallel to the greatest dimension of these wires and being propagated at a frequency below the electrical plasma frequency of the substance, each wire being made out of a conductive magnetic material having negative permeability for a range of frequencies of the electromagnetic waves below the electrical plasma frequency of the substance and when there is no external artificial static magnetic field. The wires have a circular cross-section whose diameter is greater than 1 μm.

For example, a substance of this kind is described in the following document D4:

H. García-Miquel, 1,a_ J. Carbonell,2 V. E. Boria,2 and J. Sánchez-Dehesa1, <<Experimental evidence of left-handed transmission through arrays of ferromagnetic microwires>>, APPLIED PHYSICS LETTERS 94, 054103_2009_

In this last embodiment, it is not necessary to plan for another structure in addition to the array of wires, for example an array of split rings, so that this substance will show left-handed properties in a range of frequencies. The structure of this left-handed substance is therefore simpler than that of substances using two heterogeneous materials and especially metamaterials. Indeed, this substance uses the natural ferromagnetic resonance frequency of the material used to form the conductive wires. This ferromagnetic resonance frequency is qualified as being natural because it exists in the absence of any external static magnetic field. The term "static magnetic field" designates a direct magnetic field and not an alternating magnetic field.

Furthermore, the positioning of the ferromagnetic resonance frequency in the neighborhood of the desired working frequency does not call for modifying the pitch or dimensions of the elementary cell of the wireless network. Here, it is sufficient to play on the choice of the conductive ferromagnetic material used to make the wires, i.e. for example, on an external static magnetic field. Given that it is not necessary to adapt the dimensions of the array to bring about a variation in the frequency of the ferromagnetic resonance of this substance, the sizing and tunability of this substance are simplified.

However, in practice, as illustrated by the experimental results shown in the document D4, this material has solely left-handed properties if it placed in an external static magnetic field. This is one particularly major drawback for the use of this type of left-handed substance.

SUMMARY OF THE INVENTION

The invention seeks to overcome at least one of these drawbacks by proposing a left-handed substance in which wire comprises at least one strip, made out of a conductive magnetic material, that extends along the greatest dimension of the wire in a plane of the strip and has a thickness at least twice as small as the skin thickness of the conductive magnetic material.

In the above left-handed substance, the material used to make the strips also shows a negative μ value for a range of frequencies below the electrical plasma frequency. Consequently, there is a range of frequencies for which this substance has left-handed properties. Furthermore, because of the small thickness of these strips, it is not necessary for this substance to be placed in an external static magnetic field in order to present left-handed properties. More specifically, the Filing Party is of the view that since the thickness of the strips is at least twice as small as the skin thickness, the electromagnetic field can penetrate the entire cross-section of the strip without any need to resort to an external static magnetic field. Furthermore, the small thickness of the strips naturally boosts the natural magnetization of the magnetic material so as to make it get aligned with the greatest dimension of the wires. Thus, it is no longer necessary to resort to an external static magnetic field to align the magnetization of each strip in parallel with this greatest dimension.

Thus, the left-handed substance has the same advantages as those disclosed in the document D4, without requiring any external static magnetic field.

The embodiments of this left handed material may comprise one or more of the following characteristics:

- the thickness is at least five times smaller than the skin thickness of the magnetic conductor material;
- each wire comprises a stack, alternately and in a direction perpendicular to the plane of the strip, of strips made of the conductive magnetic material and of an antiferromagnetic material,
- the antiferromagnetic material is:
  - an alloy of manganese and of at least one of the metals nickel, iridium or iron, or
  - a nickel oxide,
- each wire comprises a stack, alternating and in a direction perpendicular to the plane of the strip, of strips made out of the conductive magnetic material and out of a dielectric material in order to electrically insulate the strips of conductive magnetic material from one another,
- the conductivity of the conductive magnetic material is greater than or equal to 0.5 MS/m,
- the conductive magnetic material is a ferromagnetic material,
- the ferromagnetic resonance frequency of the material is greater than 1 GHz and advantageously greater than 5 GHz when there is no artificial external static field,
- the ferromagnetic material is an alloy of iron and/or cobalt, and/or nickel.

These embodiments of the left-handed substance furthermore have the following advantages:

- the use of a thickness five times smaller than the skin thickness limits magnetic losses for frequencies above 1 GHz;
- stacking magnetic and antiferromagnetic strips gives the following simultaneously: ferromagnetic resonance frequency of over 5 GHz without the use of any artificial static magnetic field, a state of magnetization in the ferromagnetic strip and acceptable losses, i.e. losses corresponding to a Δf line width at mid-height of less than 500 MHz;
- stacking conductive magnetic strips and strips made of dielectric material increases the fill rate and improves certain properties such as gain;
- the use of an iron, cobalt or nickel alloy to make the conductive ferromagnetic strip gives highly negative μ values, i.e. values far below −10 on a range of frequencies in which this substance has left-handed properties.

An object of the invention is also an electromagnetic waveguide device comprising:

- the above left-handed substance, and
- a wave guide to guide the incident electromagnetic waves on to the left-handed substance with an electrical field parallel to the greatest dimension of the wires and a magnetic field parallel to the plane of the strips.

An object of the invention is also an electromagnetic sender or receiver antenna comprising:

the above left-handed substance, and a radiating element capable of generating or receiving incident electromagnetic waves on the left-handed substance with an electrical field parallel to the greatest dimension of the wires and a magnetic field parallel to the plane of the strips.

Finally, an object of the invention is also a method for manufacturing the above left-handed substance comprising the etching of a layer made of conductive magnetic material whose thickness is at least twice as small as the skin thickness of this material to form the strip of conductive magnetic material of a plurality of different conductive wires.

BRIEF DESCRIPTION OF THE DRAWINGS

The invention will be understood more clearly from the following description given purely by way of an example and made with reference to the appended drawings, of which:

FIG. 1 is a schematic illustration in perspective of a left-handed substance comprising an array of wires;

FIG. 2 is a graph giving a schematic view of the shape of the curve corresponding to the real part and the imaginary part of the permeability of the substance of FIG. 1, as well as the shape of the curve corresponding to the real part and the imaginary part of its permittivity;

FIG. 3 is the schematic illustration in cross-section of a conductive wire of the array of wires of the substance of FIG. 1;

FIG. 4 is a flowchart of a method for manufacturing the left-handed substance of FIG. 1.

FIG. 8 is a schematic illustration in cross-section of the antenna of FIG. 7.

MORE DETAILED DESCRIPTION

Figure 5:
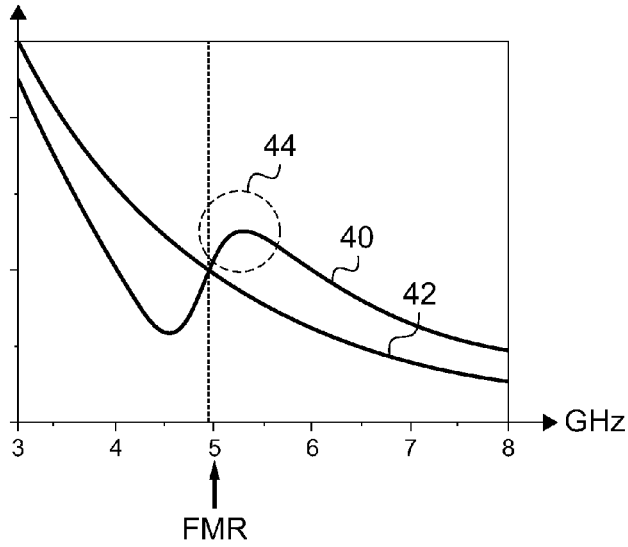
FIG. 5 is a graph of the transmission of the substance of FIG. 1.

In these figures, the same references are used to designate same elements.

Here below in this description, the characteristics and functions well known to those skilled in the art are not described in detail.

FIG. 1 shows a left-handed substance 2 having left-handed properties in the hyper-frequency range. More specifically, the substance 2 has left-handed properties in a range ΔT (FIG. 2) of working frequencies situated beyond the ferromagnetic resonance frequency (4.8 GHz in this example) and up to the electric plasma resonance frequency. It will be preferred nevertheless to work in a frequency domain for which the losses are limited (for example above 5.5 GHz in the example given).

The material 2 has an array 4 of conductive wires 6. These wires 6 are for example all identical to one another. The elementary cell of the array 4 contains only one wire 6 herein. This elementary cell is repeated with a regular pitch $p_1$ in a horizontal direction X and with a regular pitch $p_2$ in a vertical direction Z. Here, the pitch values $p_1$ and $p_2$ are for example equal. The number of repetitions of the elementary pattern in the direction X is greater than two and preferably greater than ten. The number of repetitions of the elementary pattern in the direction Z is greater than two and preferably greater than 5.

Each wire 6 extends in parallel to a direction Y perpendicular to the directions X and Z.

The array 4 and especially the pitch values $p_1$ and $p_2$ are sized in order to present a negative value of c, preferably throughout the hyper-frequency range. The array 4 therefore has an electrical plasma frequency greater than or equal to 20 GHz.

For example, the array 4 is sized through application of the teachings of the document D2.

Here, each wire 6 is obtained by a stacking, in the direction Z, of strips extending in parallel to the direction Y.

FIG. 3 is a cross-section view of a wire 6 along a plane parallel to the directions X and Z. This wire consists of a strip 20 made out of a conductive ferromagnetic material on which a strip 22 of antiferromagnetic material is superimposed in the direction Z. A strip 24 made out of conductive ferromagnetic material is also positioned above the strip 22 in the direction Z. The strips 20 and 24 are for example made out of a ferromagnetic alloy such as an alloy of iron and cobalt (for example $Fe_{65}Co_{35}$). The strip 22 is made out of an antiferromagnetic alloy such as a manganese and nickel alloy (for example: NiMn, FeMn, IrMn, etc).

Fastener strips 26 and 28 are provided at each end of this stack of ferromagnetic and antiferromagnetic strips. The fastener strip 26 is used especially to fixedly join the stack of strips 20, 22 and 24 to a substrate 30. The substrate 30 is made out of a material that does not modify the magnetic properties of the array 4. To this end, the substrate 30 is typically amagnetic. It is also preferably insulating. For example, the substrate is made out of non-doped silicon, glass, quartz, ceramic or organic material. The substrate 30 may also be made of a preformed substrate.

Here, each strip extends essentially in parallel to the direction Y so that the plane of each strip is parallel to the directions X, Y. Moreover, each strip has a rectangular cross-section. The length of each strip along the direction Y is at least twice as great as the width of the wire n the direction X and advantageously ten times greater than this width. For example, here, the length of each wire 6 is greater than 1 mm.

The thickness of the strips 20 and 24 in the direction Z is at least twice and preferably five or six times smaller than the skin thickness of the conductive magnetic material forming them. For example, the thickness is smaller than 1 μm and preferably smaller than 200 nm. The width of the strips in the direction X is greater than or equal to the thickness. Preferably, the width will be at least ten times greater than the thickness. For example, the width of each strip ranges from 10 to 100 μm.

The natural ferromagnetic resonance frequency of the conductive ferromagnetic material is strictly smaller than the plasma frequency of the substance 2. Preferably, to facilitate use, this ferromagnetic resonance frequency ranges from 1 GHz to 20 GHz. For example, the chosen material has a natural ferromagnetic resonance (called FMR in the graph of FIG. 2) frequency equal to 4.8 GHz.

This material also has a magnetic damping coefficient typically smaller than $10^{-2}$, corresponding to a mid-height line width Δf (FIG. 2) of less than 500 MHz.

The material chosen for the strips 20 and 24 here is such that, beyond the ferromagnetic resonance frequency and at least up to 20 Ghz, it has a μ value of less than −10.

Finally, the chosen conductive ferromagnetic material has a conductivity of over 0.5 MS/m. Typically, a conductivity ranging from 0.5 MS/m to 5 MS/m is appropriate.

A material simultaneously having all these properties is for example described in detail in the following document D5:

Y. LAMY and B. VIALA, "Combination of ultimate magnetization and ultra-high uniaxial Anisotropy in CoFe exchange-coupled multilayers", Journal of Applied Physics 97, 10F910 (2005)"

The graph of FIG. 2 presents electromagnetic properties of this conductive ferromagnetic material. In this graph, curves 10 and 11 represent the evolution respectively of the real and imaginary parts of the permittivity $\in$ as a function of the frequency. A dashed curve 12 represents the evolution of the imaginary part of the permittivity as a function of the frequency. A curve 14 represents the evolution of the real part of the permeability $\mu$ as a function of this same frequency.

The substance 2 can be manufactured as follows. First of all, at a step 32, the layers 26, 20, 22, 24 and 28 are deposited on the entire surface of the substrate 30 by physical, electrochemical, "chimie douce" (soft chemistry) or other conventional methods. Preferably, at the step 32, the ferromagnetic layers are deposited under magnetic field and/or annealed under magnetic field after depositing, i.e. in an environment in which there is a static magnetic field enabling the natural magnetization of the ferromagnetic material to be oriented in a predefined direction of magnetization.

Then, at a step 34, the stacking of layers is structured by the same methods as those used in microelectronics, for example lithography and etching or the like. In etching, material is removed to form stacks of strips and therefore wires 6. If the depositing and/or the annealing of the ferromagnetic layers have been done under a magnetic field, then the etching is done so that the ferromagnetic strips extend parallel to the predefined direction of magnetization. The layers may also be deposited directly through a mask or on a substrate having a pre-formed surface.

The Filing Party has noted that the substance 2 has left-handed properties in the $\Delta T$ frequency band relative to electromagnetic waves illuminating this substance with an electrical field parallel to the direction Y and a field H parallel to the direction X, i.e. in the plane of the strips. The direction of propagation k of the electromagnetic wave is parallel to the direction Z.

The left-handed properties of the substance 2 are also revealed in the graph of FIG. 5 obtained by digital simulation with finite elements. A curve 40 of the graph of FIG. 5 represents the evolution of transmission of a substance 2 as a function of frequency. Another curve 42 represents the evolution of the transmission of a substance C identical to the substance 2 except that the wires 6 are replaced by non-magnetic metal wires. Before the ferromagnetic resonance (FMR in the graph of FIG. 5) frequency, the transmission of the substance 2 constituted by magnetic conductive wires ($\in<0$ and $\mu>0$) is smaller than that of the substance C constituted by simply conductive wires ($\in<0$ and $\mu=1$). After the ferromagnetic resonance frequency, the transmission of the substance 2 constituted by magnetic conductive wires ($\in<0$ and $\mu<0$) becomes greater than that of the substance C constituted by simply conductive wires ($\in<0$ and $\mu=1$). This rise in transmission after the ferromagnetic resonance frequency demonstrates the existence of left-handed properties of the substance 2. This rise is shown surrounded by a circle 44 in FIG. 5.

Figure 6:
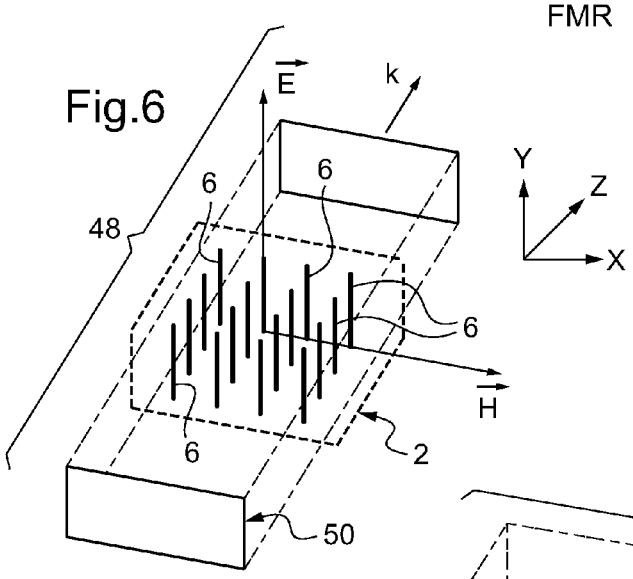
FIG. 6 is a schematic illustration in perspective of a waveguide device incorporating the substance of FIG. 1.

FIG. 6 shows an electromagnetic wave-guide device 48. This device 48 comprises:

- an electromagnetic wave guide extending along a direction Z, and
- a filter obtained by obstructing the cross-section of the guide 50 by means of the substance 2.

In this application, the wires 6 of the substance 2 extend along a vertical direction Y and the plane of the strips is parallel to a plane XY, where X is a direction perpendicular to the directions Y, Z. To simplify FIG. 6, only the wires 6 have been shown and the substrate 30 has been omitted. Preferably, each end of each wire 6 is an electrical contact with the wave guide 50.

In the guide 50, the electromagnetic waves get propagated along the direction Z. Furthermore, the guide 50 is designed so that the guided electromagnetic waves are directed towards the substance 2 with an electrical field parallel to the direction Y and a magnetic field H parallel to the plane of the strips 20, 24. The field H is therefore parallel to the direction X. Thus, for example, the substance 2 makes it possible to open a passband in a bandgap of the guide 50, which can be used to filter the guided electromagnetic waves.

In another example, the substance 2 only partially obstructs the cross-section of the guide 50. This configuration enables a phase-shift in the transmitted wave. A phase-shifter is then obtained.

In both cases, the use of the substance 2 enables the miniaturizing of the devices because the desired effects are obtained for dimensions far smaller than a half wavelength (for example $\lambda/10$).

Figure 7:
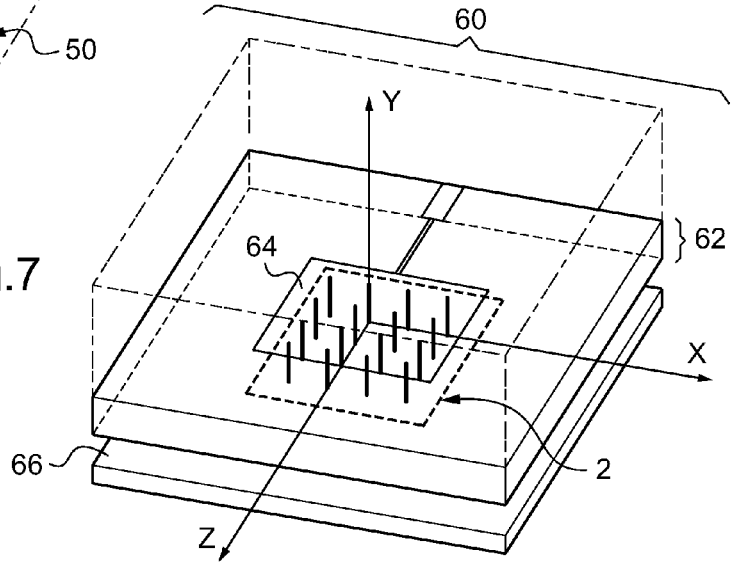
FIG. 7 is a schematic illustration in perspective of an antenna incorporating the substance of FIG. 1.

FIGS. 7 and 8 represent an antenna 60 equipped with a flat substrate 62 extending in parallel to orthogonal horizontal directions X and Z. A metal plate 64 is positioned above the substrate 62 so as to form the radiating element of a patch antenna. The plate 64 is electrically insulated from the substrate 62. A metal plate 66 is positioned beneath the substrate 62 so as to form a ground plane of the patch antenna. This plate 66 is also electrically insulated from the substrate 62. In this embodiment, the substance 2 is used to obtain the substrate 62. Similarly, the substance 2 can be used as a substrate, i.e. positioned above the metal plate 64 in the direction Y. The wires 6 of the substance 2 extend in parallel to a vertical direction Y perpendicular to the directions X and Z. The plane of the strips is parallel to the plane YX. To simplify FIGS. 7 and 8, the wires 6 have only been shown beneath the plate 64. In this embodiment (substrate), the substance 2 is used as a left-handed reflector or phase-advance reflector of the antenna 60. For example, this improves the radiating qualities of the antenna 6, such as the gain of the antenna, for unchanged dimensions (the dimension of the plate 64 along Z is equal to a half wavelength).

In another example, the invention makes it possible to miniaturize the antenna with no change in gain by using the plate 64 with a size along Z that is smaller than the half wavelength (for example $\lambda/5$). These principles of use in substrate form (or superstrate form) can also be applied to a dipolar antenna (which would be positioned here along the axis Y) such as the wires 6 which form the substance 2 extending parallel to the axis of the dipole. The substance 2 is then positioned about this dipole in a direction parallel to the plane XZ.

Many other embodiments are possible. For example, the natural ferromagnetic resonance frequency is not necessarily below 20 GHz.

The magnetic material used to make the magnetic strips is not necessarily homogeneous. For example, the magnetic material may be a material obtained out of a ferromagnetic nano-powder aggregated by means of a binder. In this description, a material is deemed to be homogeneous if it is made out of a single magnetic alloy. Conversely, a material is considered to be heterogeneous if it is made of a magnetic alloy and a dielectric material.

The cross-section of the strips is wider than it is thick, but not necessarily rectangular. For example, the cross-section may ellipsoidal with very low eccentricity.

The conductive wires may be made by stacking ferromagnetic and antiferromagnetic layers in the reverse order to the scheme described with reference to FIG. 3. We then obtain a stack, in the direction Z, of an antiferromagnetic layer, a ferromagnetic layer, and then again an antiferromagnetic layer.

It is also possible to make a wire by stacking several magnetic strips on one another and insulating them electrically from one another by means of strips made of dielectric material. This prevents the appearance of eddy currents and increases the fill rate in magnetic material.

In a simplified embodiment, each wire is formed by a single magnetic strip.

As a variant, the elementary pattern of the array of wires is repeated solely in one direction or in more than two directions.

As a variant, the substrate 30 is made out of a ferromagnetic or piezoelectric material. Thus, the ferromagnetic resonance frequency is adjustable by playing on the voltage applied to this substrate.

Preferably, the wires 6 are surrounded by a dielectric material such as silica or resin, presenting permittivity greater than that of air. However, they can also be surrounded by air.

In another embodiment of the device 48, the plane of the strips is parallel to the plane YZ. In this case the field H of the electromagnetic wave is parallel to the direction Z.

The invention claimed is:

1. A left-handed substance comprising an array of conductive wires positioned relative to one another in such a way as to present a negative permittivity relative to electromagnetic waves that have an electrical field parallel to a direction along which the conductive wires extend and that are propagated at a frequency below the electrical plasma frequency of the substance, each wire being made out of a conductive magnetic material having negative permeability for a range of frequencies of the electromagnetic waves below the electrical plasma frequency of the substance in the absence of an external artificial static magnetic field, wherein each wire comprises at least one strip defining a plane, made out of a conductive magnetic material, said strip extending along said direction in the plane defined by the strip and that has a thickness that is less than or equal to one half the skin thickness of the conductive magnetic material at said frequency and less than 1 micrometer.

2. The substance according to claim 1, wherein the thickness is at least one-fifth of the skin thickness of the conductive magnetic material.

3. The substance according to claim 1, wherein each wire comprises a stack of strips, said stack of strips comprising at least a first strip adjacent to a second strip, wherein said first strip is made of the conductive magnetic material and wherein the second strip is made of an antiferromagnetic material.

4. The substance according to claim 3, wherein the antiferromagnetic material is: an alloy of manganese and at least one metal selected from the group consisting of nickel, iridium, and iron.

5. The substance according to claim 1, wherein each wire comprises a stack of strips comprising at least a first strip, a second strip adjacent to said first strip, and a third strip adjacent to said second strip, wherein said first strip and said third strip are made out of the conductive magnetic material and wherein said second strip is made out of a dielectric material in order to electrically insulate said first strip from said third strip.

6. The substance according to claim 1, wherein the conductivity of the conductive magnetic material is greater than or equal to 0.5 MS/m.

7. The substance according to claim 1, wherein the conductive magnetic material is a ferromagnetic material.

8. The substance according to claim 7, wherein, in the absence of an artificial external static magnetic field, the ferromagnetic resonance frequency of the material is greater than 1 GHz.

9. The substance according to claim 7, wherein the ferromagnetic material comprises an alloy of metals selected from the group consisting of iron, cobalt, and nickel.

10. An electromagnetic wave-guide device comprising: a left-handed substance as recited in claim 1, and a wave guide to guide the incident electromagnetic waves on to the left-handed substance with an electrical field parallel to the direction along which the conductive wires extend and a magnetic field parallel to the plane defined by the strip.

11. An electromagnetic sender or receiver antenna comprising: a left-handed substance according to claim 1, and a radiating element capable of generating or receiving incident electromagnetic waves on the left-handed substance with an electrical field parallel to a direction along which the conductive wires extend and a magnetic field parallel to the plane defined by the strip.

12. A method for manufacturing a left-handed substance according to claim 1, said method comprising etching a layer made of conductive magnetic material that is less than or equal to one half the skin thickness of said material and less than 1 micrometer to form the strip made of conductive magnetic material for a plurality of different conductive wires.

13. The substance according to claim 7, wherein the ferromagnetic resonance frequency of the material is greater than 5 GHz when there is no artificial external static magnetic field.

14. The substance of claim 1, wherein the thickness of the strip, which is made of a conductive magnetic material, is less than 200 nm.

15. The substance of claim 3, wherein the antiferromagnetic material is a nickel oxide.

* * * * *